United States Patent [19]

Burchette, Jr. et al.

[11] 4,050,645

[45] Sept. 27, 1977

[54] YARN CARRIER

[75] Inventors: Robert L. Burchette, Jr., Spartanburg; Edward J. Harris, Clemson, both of S.C.

[73] Assignee: Plastic Injectors, Inc., Spartanburg, S.C.

[21] Appl. No.: 620,561

[22] Filed: Oct. 8, 1975

[51] Int. Cl.[2] ..... B65H 75/28

[52] U.S. Cl. ..... 242/125.1; 242/18 PW

[58] Field of Search ..... 242/125.1, 125, 125.2, 242/18 EW, 18 PW, 18 R, 118.11, 118.32, 118.3, 118.31, 18 A; 57/34 TT

[56] References Cited

U.S. PATENT DOCUMENTS

| | | | |
|---|---|---|---|
| 3,095,161 | 6/1963 | Atwood et al. | 242/118.3 X |
| 3,284,023 | 11/1966 | Sowell | 242/125.1 |
| 3,717,291 | 2/1973 | Adams et al. | 242/125.1 |
| 3,827,652 | 8/1974 | Burchette | 242/118.11 |
| 3,876,165 | 4/1975 | Comer | 242/125.1 |
| 3,887,145 | 6/1975 | Egyptien et al. | 242/125.1 |
| 3,941,322 | 3/1976 | Hewitt | 242/18 R |

OTHER PUBLICATIONS

Textile World - June, 1975 -McGraw-Hill, p. 79.

*Primary Examiner*—George F. Mautz
*Attorney, Agent, or Firm*—Wellington M. Manning, Jr.; Luke J. Wilburn, Jr.

[57] ABSTRACT

A cylindrical yarn carrier having improved means for producing a transfer tail adjacent an end thereof. The cylindrical yarn carrier may be a solid tube, a perforated rigid tube for dyeing or a collapsible yarn dye tube. An end of the tube at which the transfer tail is produced may have a segment along the lengths thereof where the surface of the carrier is irregular or roughened and has a groove therearound that receives a plurality of wraps of yarn therein to produce the transfer tail while further serving as a storage area for same. An opposite end of the tube has a yarn hook means to engage the yarn and permit same to be wound around the package.

10 Claims, 5 Drawing Figures

YARN CARRIER

BACKGROUND OF THE INVENTION

Numerous operations are encountered throughout the textile manufacturing processes where yarn during or after handling is wound around a carrier for storage, or further processing. Such carriers are generally cylindrical, conical or of other similar shapes to receive and store the yarn without producing any damage thereto. In each of the operations where a yarn package is produced around a carrier, it is desirable to provide a length of yarn known as a transfer tail on the package to permit continuous further processing thereof from package to package. Various and sundry techniques have heretofore been devised for enabling production of the transfer tails somewhere along the length of the carrier.

The present invention is directed to a yarn carrier having an improved means for producing a transfer tail therealong. A tubular carrier is generally envisioned having a yarn hook means located on one end of the carrier and an improved transfer tail production and storage area at an opposite end of the carrier. The present invention represents a technological advance and no prior art is known that would anticipate or suggest same.

SUMMARY OF THE INVENTION

It is an object of the present invention to provide an improved yarn carrier.

Another object of the present invention is to provide a yarn carrier having improved transfer tail storage means thereon.

Still another object of the present invention is to provide an improved cylindrical yarn carrier that is particularly useful in an open end spinning operation and has an improved transfer tail producing means thereon.

Yet another object of the present invention is to provide an improved yarn carrier that may be solid, may be perforated or may be collapsible and which has an improved yarn transfer tail production means therealong.

Generally speaking, the present invention is directed to an improved yarn carrier, said yarn carrier comprising an elongated cylindrical member, said member having a yarn hook means located adjacent one end thereof and a transfer tail receiving groove at an opposite end thereof.

More specifically, the yarn carrier of the present invention comprises an elongated cylindrical body that generally has a substantially common inside and outside diameter profile along the length thereof. The cylinder may be solid along its length or interrupted by a plurality of perforations through the cylindrical side walls. Likewise, the cylindrical side walls may be abbreviated and represented only by one or more helical leads that are integral with and secured between opposite end flanges to provide the cylinder. Hence, the tube may have various side walls and preferably is constructed from a synthetic polymeric material by way of an injection molding or similar process. Suitable synthetic polymeric materials include polypropylene, polyethylene, polyvinyl chloride and the like with suitability being determined by the process conditions to which the carrier will be subjected. Adjacent one end of the cylindrical body is located hook means to snare yarn during rotation of the cylinder. Several hook members may be positioned around the periphery of the tube. Located adjacent an opposite end of the cylinder is a transfer tail receiving depression or groove which is provided in the cylindrical body side wall. Wraps of yarn are initially placed around the yarn carrier of the present invention in the transfer tail area. Prior carriers have experienced problems with yarn sloughing off the end of the carrier. With the present carrier, the transfer tail yarn is received and held in the groove around the yarn carrier.

In a preferred embodiment of the present invention, the groove around the carrier body is radiused on the side of the groove towards the center of the carrier while the opposite side of the groove is defined by a square cut shoulder. This configuration better enables collection of the yarn during production of the transfer tail and as such, is a preferred structural configuration of the groove to prevent yarn from passing through the groove and off the carrier. Likewise in a preferred embodiment the inside of the transfer tail groove is irregular or roughened to lessen slippage of yarn.

In a most preferred embodiment, the yarn carrier of the present invention is a solid tube having at least one and preferably a plurality of yarn hook members around an upper end thereof. The surface of the cylinder has a multiplicity of side by side grooves along the length thereof whereby the cylinder presents a smooth circumferential surface and a frictional axial surface. An opposite end of the solid cylinder from the hook members has a wide groove adjacent thereto with the groove being of sufficient capacity to receive a plurality of wraps of yarn and having an outer edge that is perpendicular to the outer body wall of the cylinder.

DESCRIPTION OF THE PREFERRED EMBODIMENTS

Making reference to the Figures, preferred embodiments of the present invention will now be described in detail. A yarn carrier generally indicated as 10 is defined by cylindrical side walls 12 with yarn engaging hook means 14 provided at one end thereof and a transfer tail receiving area 20 provided at an opposite end thereof. The surface of cylindrical side walls 12 should be smooth in the circumferential direction of the tube so as to permit yarn to slide thereacross in a direction transverse to the longitudinal axis of the tube, while affording some frictional resistance in an angular or axial direction with respect to the longitudinal axis of the tube. Such a surface is provided by a multiplicity of closely spaced small grooves 17.

Figure 1:
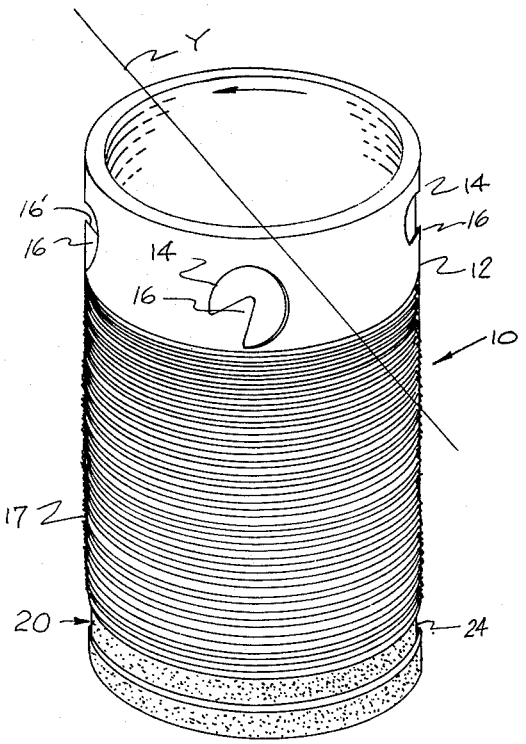
FIG. 1 is an isometric view of a yarn carrier according to the teachings of the present invention.
Figure 2:
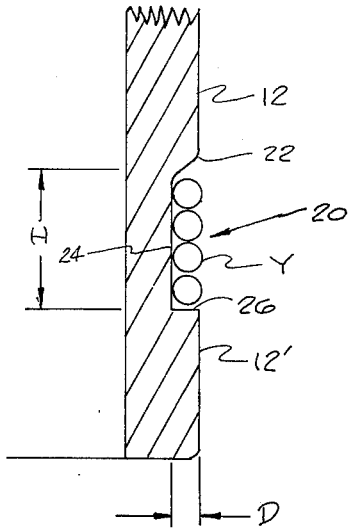
FIG. 2 is an enlarged partial vertical cross sectional view through a side wall of a tube according to the teachings of the present invention illustrating in detail the transfer tail collection means according to the present invention.

In FIG. 2, the transfer tail receiving groove 20 is illustrated in enlarged detail and shows a beveled side wall 22, a flat bottom 24 and a straight side wall 26 which is the outer side wall of the transfer tail groove. In this fashion, yarn Y which is seen within groove 20, passes from the inner side wall 22 downwardly towards side wall 26. The bevel of side wall 22 permits the yarn Y to immediately pass within groove 20 where it is encountered by the straight side wall 26 which forms a square shoulder with the outer edge 12' of cylinder wall 12. In a further preferred arrangement as illustrated in FIG. 2, the height H of groove 20 exceeds the depth D so as to provide a substantial groove for receiving yarn as compared to the closely spaced grooves 17 that extend at least a portion of the length of the cylinder. Likewise, in a preferred embodiment, the bottom wall 24 of groove 20 is irregular or roughened as illustrated in FIG. 1 along with adjacent portions of cylinder wall 12.

Figure 3:
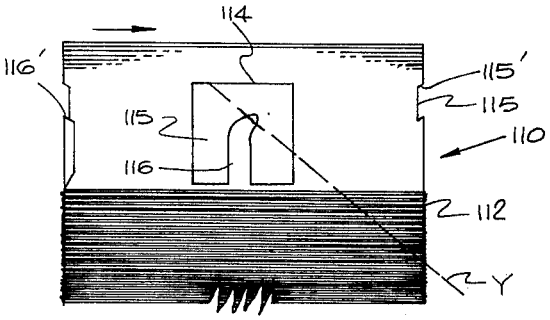
FIG. 3 is a partial elevational view of a yarn carrier showing a further yarn hook embodiment according to the present invention.

In FIG. 3, a solid cylinder wall 112 is provided having a plurality of yarn hook means 114 disposed therearound. Hook means 114 of FIG. 3 differ from those of FIG. 1 by way of shape. Further in this regard, one important facet of the yarn hook means 114 includes a cut down area 115 having a bevel 115', the purpose of which will be described hereinafter. A central member 116 is provided and has an undercut 116' that engages a yarn Y shown in phantom in FIG. 3 as the tube 110 is rotated in the direction of the arrow. Yarn Y passing in the path of the hook member 116 is thus engaged by the undercut portions 116' thereof and immediately begins to traverse the length of the tube. Adjacent a lower end thereof, the yarn is engaged by a tailing slot (not shown) which permits withdrawal of yarn from the waste duct to the immediate location of the transfer tail receiving area whereby the transfer tail is produced thereat.

Figure 4:
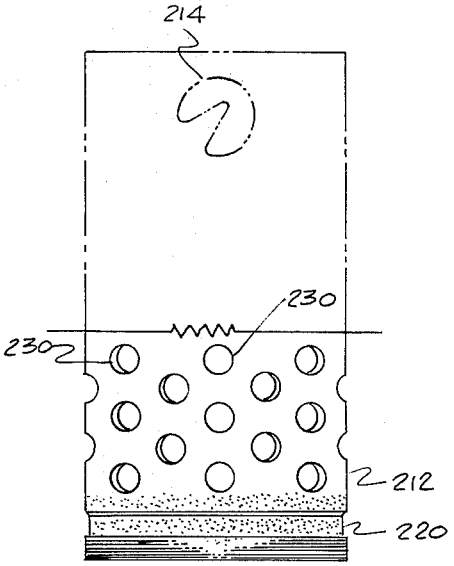
FIG. 4 is an elevational view of a yarn carrier according to the present invention illustrating a further embodiment as to the side wall of the tube.
Figure 5:
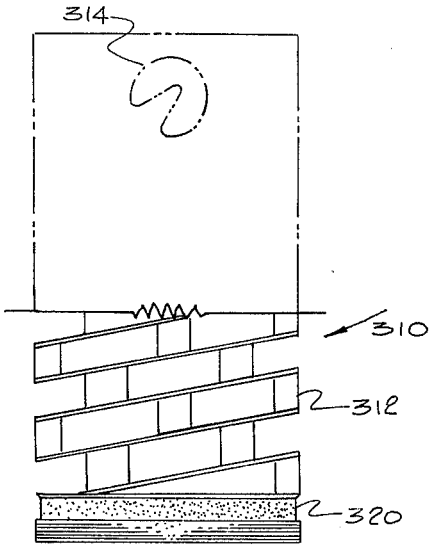
FIG. 5 is an elevational view of a yarn carrier according to the teachings of the present invention illustrating a further suitable side wall therefor.

Further body structures are illustrated in FIGS. 4 and 5. Note in FIG. 4, for example, a plurality of perforations 230 that are provided in cylinder wall 212. Perforations 230 enable the yarn carrier to be used in a yarn dye operation whereby once the yarn package is placed in the dye bath, dye liquor may pass through perforations 230 into intimate contact with the yarn wrapped therearound. Otherwise, the yarn hook means 214 would be provided at an upper end of the tube while the transfer tail receiving groove 220 is provided at a lower end of the tube. In the embodiment shown in FIG. 5, the side wall 312 of the cylinder 310 is provided by a plurality of helical leads of the general type described in U.S. Pat. No. 3,827,652 to Robert L. Burchette, Jr., though any of the other collapsible structures may be employed. Likewise, as with the embodiments of the cylinders of FIGS. 1 and 4, an upper end of the tube as illustrated in FIG. 5 has yarn hook means 314 while a lower end has a transfer tail receiving groove 320.

In operation, a yarn carrier as defined by the present invention will function as follows in an open end spinning operation which is a preferred area of use for the carrier. Yarn being produced by open end spinning is passed into a waste suction duct along a particular yarn path. A carrier tube 10 is then brought into the path of the yarn Y, while the yarn slips thereacross making contact with the surface of the cylinder in a circumferential direction. Thereafter, rotation of the tube 10 and further movement of same brings the yarn Y into contact with the yarn hook means 14 at an approximate angle as illustrated in FIGS. 1 and 3. The hook means 14 engages the yarn at the undercuts 16' and 116' and causes same to be traversed along the length of tube 10. At a lower end of tube 10, the yarn falls into a tailing slot (not shown) which permits withdrawal of yarn from the waste duct which is wrapped around the package at the transfer tail receiving area 20. Once the transfer tail has been produced and stored in groove 20, the yarn at the tailing slot is clipped and yarn traverse continues along the length of tube 10 to produce a proper package therearound.

Once the package has been produced, if, for example, the package has a side wall structure as illustrated in FIGS. 4 and 5, further processing of the yarn in the present condition could be dyeing. The concept in FIG. 4 envisions a straight yarn dye operation while according to FIG. 5, a collapsible tube is provided and improved dye capacity is afforded the dye kettle. In any event, one may use a collapsible tube as exemplified in FIG. 5, whereby the tube could be used as a simple yarn carrier, a simple dye tube, or a collapsible dye tube. In this fashion, better versatility is afforded the yarn producers.

As mentioned above, a preferred carrier is one that has been molded of a synthetic polymeric material by an injection molding process. All component parts of the carrier are of integral construction to form a unitary product. In fact, the irregular or roughened surface 25 in groove 20 is preferably molded into the product, though it may be added at a later time. It should be pointed out, however, that the groove and yarn hook could be pressed into a molded or wrapped paper yarn carrier.

Having described the present invention in detail, it is obvious that one skilled in the art will be able to make variations and modifications thereto without departing from the scope of the invention. Accordingly, the scope of the present invention should be determined only by the claims appended hereto.

What is claimed is:

1. An improved yarn carrier comprising:

a. an elongated tubular body;

b. yarn hook means provided on said body adjacent, but away from an end thereof, said yarn hook means being engageable with a yarn passing thereby to initiate wrapping same around said body; and c. a transfer tail receiving groove extending around said body, adjacent, but away from an opposite end of said body to said yarn hook means, said groove being defined by a sloped inner wall with respect to said opposite end of said carrier, an outer wall with respect to said opposite end of said carrier, said outer wall being generally perpendicular to an outer surface of said body and a bottom wall connecting said inner and outer walls and defining a yarn receiving surface, said groove having a height greater than the depth from the outer surface of the body to the yarn receiving surface.

2. A yarn carrier as defined in claim 1 wherein said groove has an irregular surface on said bottom wall thereof.

3. A yarn carrier as defined in claim 1 wherein said tubular body is solid along its length.

4. A yarn carrier as defined in claim 1 wherein said tubular body has a plurality of perforations along its length.

5. A yarn carrier as defined in claim 1 wherein said tubular body has an abbreviated structure, said structure being yieldable to be collapsible.

6. An improved yarn carrier comprising:

a. an elongated solid tubular body, said body having a plurality of adjacent circumferential grooves therearound along at least a major portion of the length thereof;

b. a plurality of yarn hook means disposed around said body adjacent, but away from an end of same, said yarn hook means having a member with an undercut end portion partially therearound, to snare a yarn passing thereby; and c. a transfer tail receiving groove extending around said body, adjacent, but away from an opposite end of said body to said yarn hook means, said groove being defined by a sloped inner wall with respect to said opposite end of said carrier, an outer wall with respect to said opposite end of said carrier, said outer wall being generally perpendicular to peripheral surface of said body and a bottom wall connecting said inner and outer walls and defining a yarn receiving surface, said groove having a height greater than the depth from the peripheral surface of the body to the yarn receiving surface.

7. A yarn carrier as defined in claim 6 wherein said bottom wall is generally flat.

8. A yarn carrier as defined in claim 7 wherein said bottom wall has an irregular surface.

9. A yarn carrier as defined in claim 6 wherein said tubular body has a plurality of perforations along the length thereof.

10. A yarn carrier as defined in claim 6 wherein said tubular body has an abbreviated structure, said structure being yieldable to be collapsible.

* * * * *